US008397423B2

(12) United States Patent
Robinson

(10) Patent No.: US 8,397,423 B2
(45) Date of Patent: Mar. 19, 2013

(54) SIGHT MOUNT FOR ANTIQUE RIFLES

(76) Inventor: Douglas Robinson, Alix (CA)

( * ) Notice: Subject to any disclaimer, the term of this patent is extended or adjusted under 35 U.S.C. 154(b) by 132 days.

(21) Appl. No.: 13/159,869

(22) Filed: Jun. 14, 2011

(65) Prior Publication Data

US 2012/0317861 A1 Dec. 20, 2012

(51) Int. Cl.
*F41G 1/38* (2006.01)

(52) U.S. Cl. ..... 42/124; 42/125; 42/126; 33/297

(58) Field of Classification Search ..... 42/124, 42/125, 126; 33/297
See application file for complete search history.

(56) References Cited

U.S. PATENT DOCUMENTS

| | | | | |
|---|---|---|---|---|
| 3,834,052 | A | 9/1974 | Steck, III | |
| 3,986,285 | A | 10/1976 | Krisay | |
| 4,174,581 | A | 11/1979 | Castellano | |
| 4,367,606 | A | 1/1983 | Bechtel | |
| 4,455,776 | A | 6/1984 | Ashley et al. | |
| 4,873,779 | A | 10/1989 | Ellison et al. | |
| 6,591,538 | B2 * | 7/2003 | Holler | 42/125 |
| 7,661,221 | B2 * | 2/2010 | Holmberg | 42/106 |
| 7,827,724 | B1 | 11/2010 | Spinelli | |
| 2010/0018103 | A1 | 1/2010 | Holmberg | |
| 2010/0263256 | A1 | 10/2010 | Spinelli | |

* cited by examiner

*Primary Examiner* — J. Woodrow Eldred
(74) *Attorney, Agent, or Firm* — Maxey Law Offices, PLLC; Stephen Lewellyn

(57) ABSTRACT

A sight mount for mounting an optical sight to the tang of an antique rifle or replica without undesirable modification to the rifle is provided. The sight mount includes a tang mount porting having first and second tang mounting openings positioned to cooperate with spaced fasteners extending through a top side of the tang of the rifle, a scope mount portion configured to detachably receive in a mounting relation thereto a sight and position the sight at a spaced location above and generally parallel to the barrel of the rifle when the tang mount portion is mounted to the tang of the rifle, and a vertical plate portion joining together said tang mount portion and said scope mount portion.

12 Claims, 3 Drawing Sheets

FIG. 3
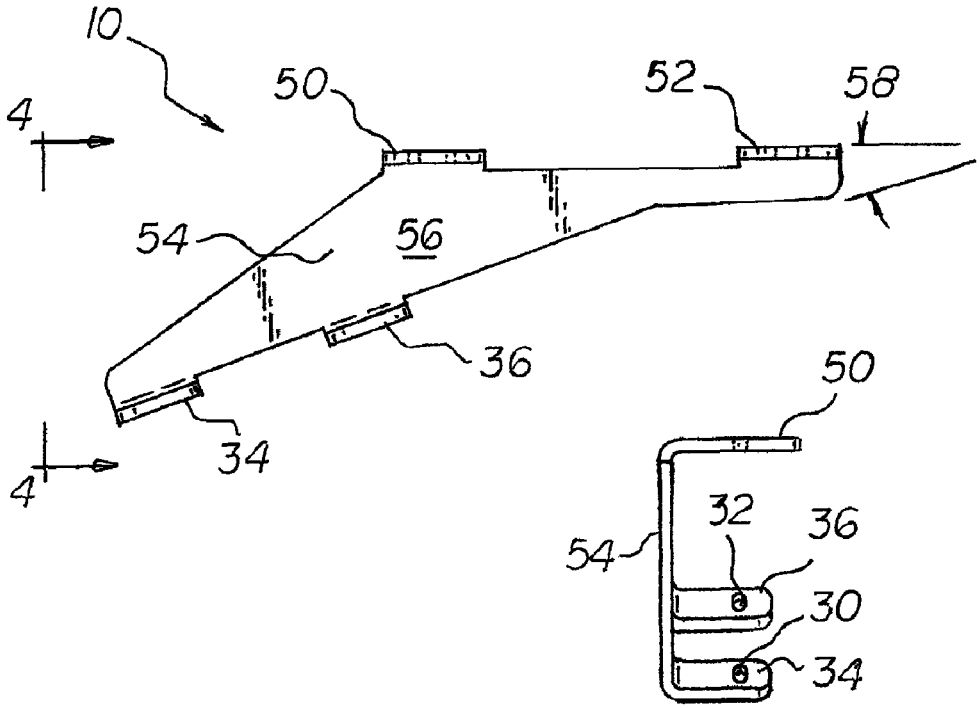
FIG. 4
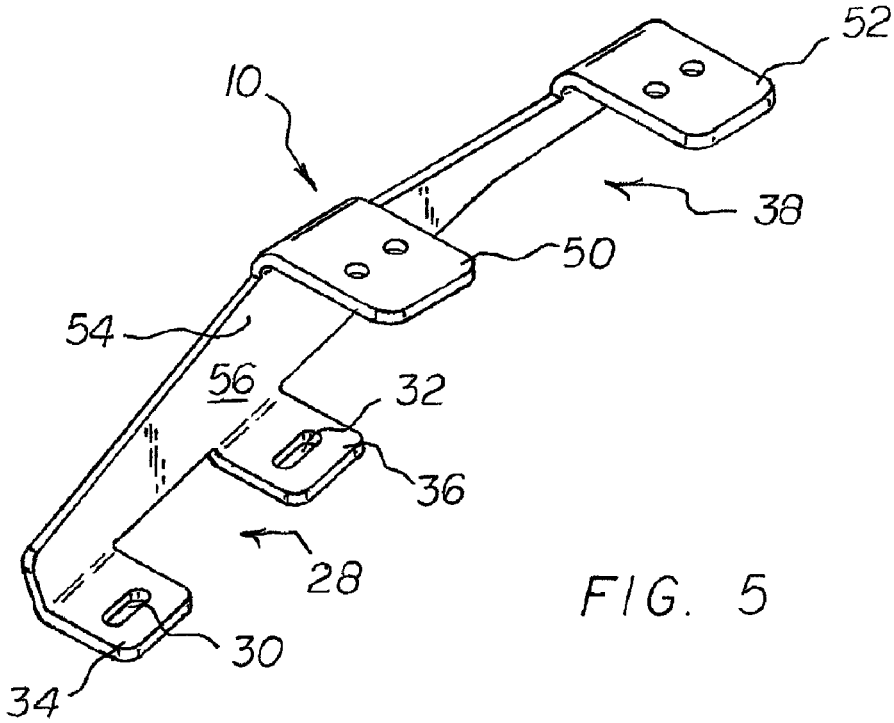
FIG. 5

SIGHT MOUNT FOR ANTIQUE RIFLES

FIELD OF THE INVENTION

The present invention relates generally to a mount for attaching optical sights to a rifle, and more particularly, relating to a mount for attaching an optical sight to the tang of an antique rifle without devaluing the rifle and without modification to the operation of the rifle.

BACKGROUND OF THE INVENTION

There exists mounts for attaching optical sights to firearms, and particularly, rifles having a myriad of constructions to meet their respective objectives and requirements. The vast majority of these existing mounts are for modern rifles that are manufacture to include specific configurations permitting use of the mounts in attaching an optical sight to the rifle without undesirable modification to the rifle. Unlike modern rifles, antique rifles were manufactured before the advent of optical sights and therefore did not include the provisions that exist in modern rifles that permit the attachment of optical sights. Therefore, if one desires to mount an optical sight to an antique rifle the rifle must be modified to include provisions which permit the mounting. In most instances, it is undesirable to modify these rifles because a modified rifle has less value than an unmodified rifle. Additionally, some modifications may require altering the action of the rifle or may result in condition rendering the rifle unsafe to fire.

Accordingly, there remains a need for a sight mounting device for antique rifles and antique replica rifles which does not require undesirable modification to the rifle that devalues the rifle or renders the rifle unsafe to fire.

SUMMARY OF THE INVENTION

Embodiments of the present invention address this need by providing a sight mount that permits the mounting of an optical sight to an antique rifle or replica without undesirable modification to the rifle.

Embodiments of the present invention also provide a sight mount that is configured to be secured to the antique rifle or replica using fasteners existing in the rifle.

Embodiments of the present invention further provide a sight mount that is configured to be secured to a top side of a tang portion of an antique rifle or replica with existing fasteners used to secure a stock of the rifle to the tang portion of the rifle.

To achieve these and other advantages, in general, in one aspect, a sight mount for a rifle having a stock that is attached to a tang extending from the receiver of the rifle is provided. The sight mount includes a tang mount porting having first and second tang mounting openings positioned to cooperate with spaced fasteners extending through a top side of the tang of the rifle, a scope mount portion configured to detachably receive in a mounting relation thereto a sight and position the sight at a spaced location above and generally parallel to the barrel of the rifle when the tang mount portion is mounted to the tang of the rifle, and a vertical plate portion joining together said tang mount portion and said scope mount portion.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and sight of the present invention.

For a better understanding of the invention, its operating advantages and the specific objects attained by its uses, reference should be had to the accompanying drawings and descriptive matter in which there is illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings:

FIG. 3 is a side view of an embodiment of the sight mount;

FIG. 4 is a back view of an embodiment of the sight mount; and

FIG. 5 is a perspective view of an embodiment of the sight.

DETAILED DESCRIPTION OF THE INVENTION

Figure 1:
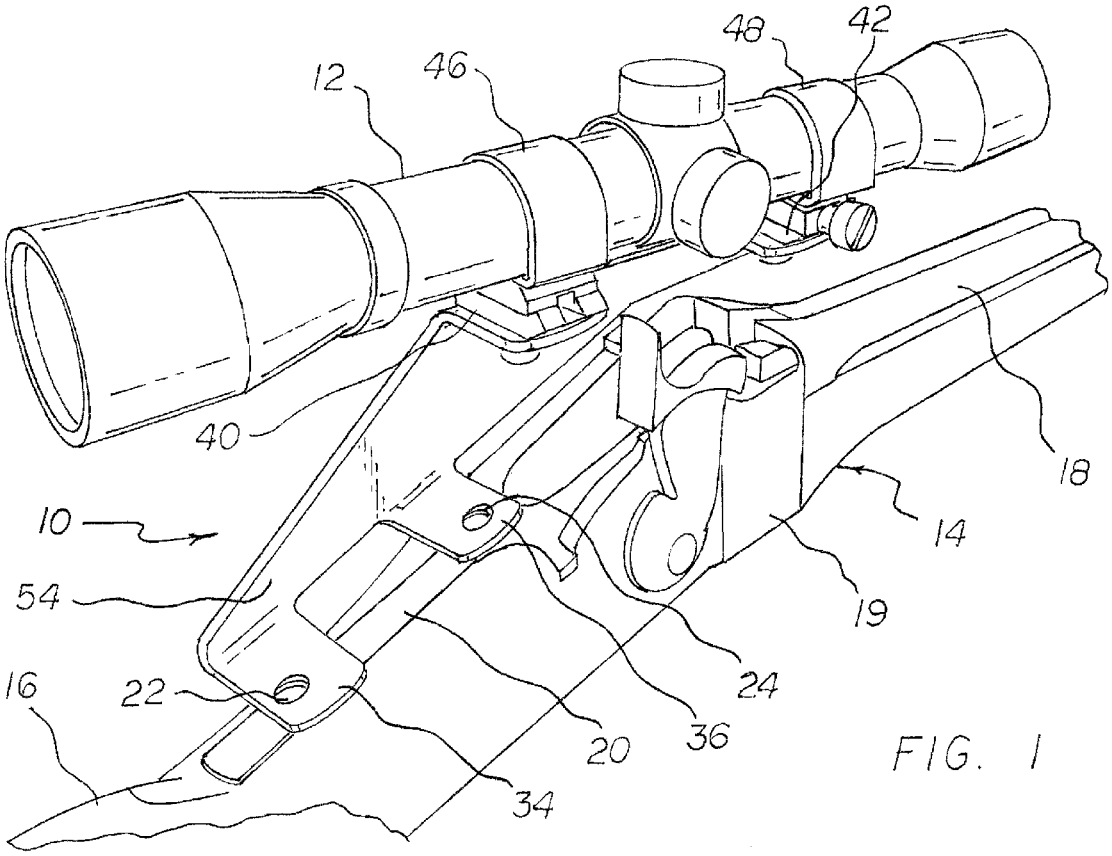
FIG. 1 is a perspective view of a rifle and optical sight assembly comprising a sight mount constructed in accordance with the principles of the present invention.
Figure 2:
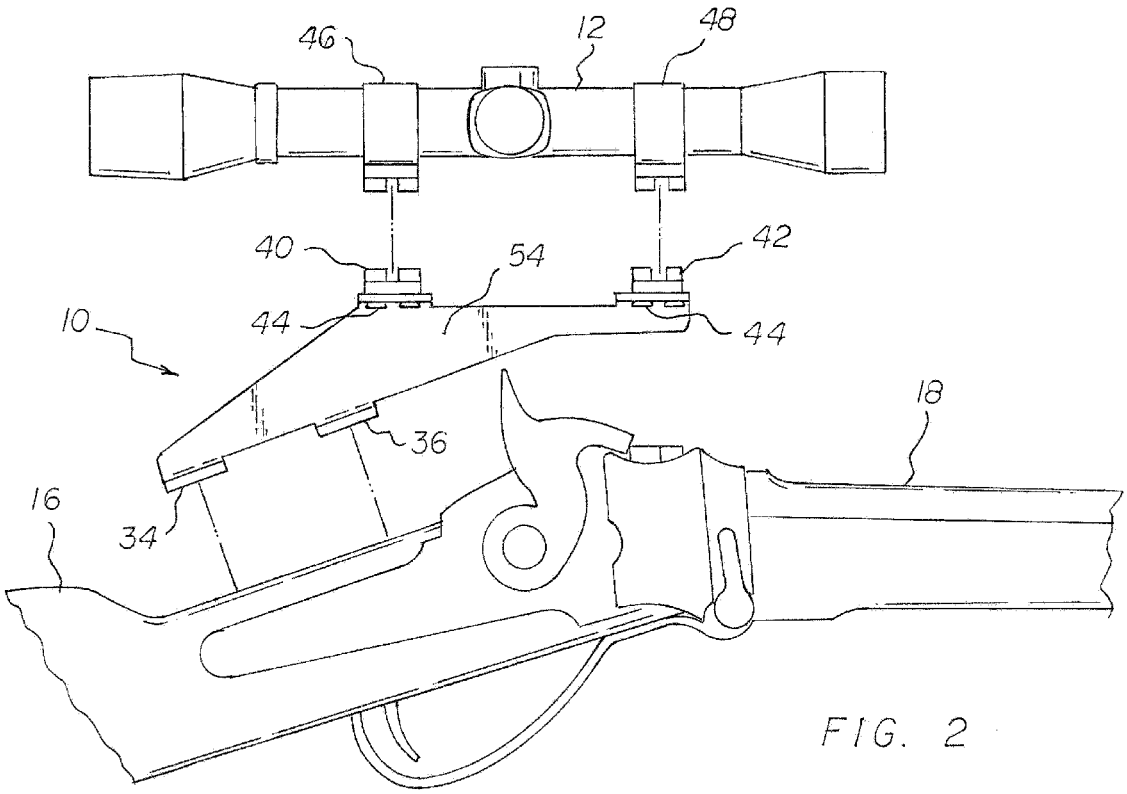
FIG. 2 is a side exploded view of a rifle and optical sight assembly comprising a sight mount constructed in accordance with the principles of the present invention.

With reference to FIGS. 1 through 5 there is illustrated new a rifle sight mount constructed in accordance with the principals of the invention and designated generally by reference number 10.

Mount 10 is used to operatively secure a modern rifle sight 12 to an antique or antique replica rifle 14 in a manner which does not reduce the value of the rifle and which does not modify the operating components of the rifle. As illustrated, mount 10 is designed for a rifle 14 including barrel 18, a stock 16 that is attached to a receiver 19 of the rifle by an interconnecting tang 20 that extends from the receiver. The stock 16 is secured to the tang 20 by screw fasteners 22 and 24 extending a top side 26 of the tang and which cooperatively engage the stock and tang.

Rifle sight mount 10 includes a tang attachment portion 28 including first and second tang mount openings 30 and 32 that are positioned to cooperate with fasteners 22 and 24. In the embodiment illustrated, the tang attachment portion 28 includes first and second tang mount tabs 34 and 36 extending in a generally parallel spaced relationship and where the first tang mount tab includes tang mount opening 30 and the second tang mount tab includes tang mount opening 32. Tang mount openings 30 and 32 may be elongated slots to permit cooperative alignment with fasteners 22 and 24 having different spacing between various rifle constructions.

Rifle sight mount 10 further includes a sight mount portion 38 configured to detachably receive in a mounting relation thereto the rifle sight 12. Sight mount portion 38 is fitted with one or more mounting rails 40 and 42, such as conventional weaver or picatinny type rails. As illustrated, mounting rails 40 and 42 are attached to the sight mount portion 38 by suitable fasteners 44. Alternatively, one or more mounting rails such as 40, 42 may be integral with the sight mount portion 38. Mounting rails 40 and 42 cooperate with conventional weaver or picatinny sight rings 46 and 48 which are configured to receive and retain the rifle scope 12 for mounting. In the embodiment illustrated, the scope mount portion 38 includes first and second scope mount tabs 50 and 52 extending in a generally parallel spaced relationship and where the scope mount tab includes mounting rail 40 and the second scope mount tab includes mounting rail 42.

Rifle scope mount 10 further includes a vertical plate portion 54 joining the tang attachment portion 28 and scope mount portion 38 in a fixed relationship to one another. However, the tang attachment portion 28 and/or the scope mount portion 38 could be joined together by vertical plate portion 54 in manner that permits relative adjustment therebetween to fit various rifle configurations. The tang attachment portion 28 and the scope mount portion 38 extend from the same side 56 of the vertical plate portion 54 at a spaced distance and together form an acute angle 58 therebetween such that the scope mount portion is positioned at a spaced distance above and generally parallel to the barrel 18 of the rifle 14, thereby preventing the action of the rifle from contacting the rifle scope mount 10 or the rifle scope 12.

In an embodiment, the rifle scope mount 10 can be fabricated from a single plate of steel or similar strength material by initially cutting the plate into a desired geometric shape that corresponds to a particular rifle from a larger section of plate steel. The tang mount portion 28 and scope mount portion 38 are then formed by bending the plate at the respective interface edges with the vertical plate portion 54.

The operation and use of the invention hereinabove described is evident to those skilled in the art to which it relates from a consideration of the foregoing. Accordingly, a detailed description of the operation and use of the invention is not required beyond A number of embodiments of the present invention have been described. Nevertheless, it will be understood that various modifications may be made without departing from the spirit and scope of the invention. Accordingly, other embodiments are within the scope of the following claims.

What is claimed is:

1. A sight mount for mounting an optical sight to a rifle having a stock that is attached to a tang extending from the receiver of the rifle, the sight mount comprising:

a tang mount portion including first and second tang mounting openings positioned to cooperate with spaced fasteners extending a top side of the tang of the rifle;

a scope mount portion configured to detachably receive in a mounting relation thereto an optical sight and position the optical sight at a spaced location above and generally parallel to a barrel of the rifle when said tang mount portion is secured to the tang of the rifle; and a vertical plate portion joining together said tang mount portion and said scope mount portion.

2. The sight mount of claim 1, wherein said tang mount portion and said scope mount portion are joined together in a fixed relation by said vertical plate portion.

3. The sight mount of claim 2, wherein said tang mount portion is comprised of first and second tang mount tabs in a generally spaced parallel relation, each of said first and second tang mount tabs including one of said tang mounting openings; and wherein said scope mount portion is comprised of first and second scope mount tabs in a generally spaced parallel relation.

4. The sight mount of claim 3, wherein each of said first and second scope mount tabs included a mounting rail.

5. The sight mount of claim 1, wherein said scope mount portion includes one or more mounting rails.

6. The sight mount of claim 1, wherein said tang mount portion and said scope mount portion form an acute angle therebetween.

7. A rifle and sight assembly, comprising:

a rifle having a stock attached to a tang of the rifle;

a sight mount including a tang mount portion having first and second tang mounting openings positioned to cooperate with spaced fasteners through a top side of said tang, said tang mount portion attached to said tang by said threaded fasteners extending through said tang mount openings, a scope mount portion configured to detachably receive in a mounting relation thereto an optical sight and position the optical sight at a spaced location above and generally parallel to said barrel of said rifle, and a vertical plate portion joining together said tang mount portion and said scope mount portion; and an optical sight attached to said scope mount portion.

8. The assembly of claim 7, wherein said tang mount portion and said scope mount portion are joined together in a fixed relation by said vertical plate portion.

9. The assembly of claim 8, wherein said tang mount portion is comprised of first and second tang rail tabs in a generally spaced parallel relation, each of said first and second tang rail tabs including one of said tang mounting openings; and wherein said scope mount portion is comprised of first and second scope mount tabs in a generally spaced parallel relation.

10. The assembly of claim 9, wherein each of said first and second scope mount tabs included a mounting rail and said optical sight is attached to each mounting rail.

11. The assembly of claim 7, wherein said scope mount portion includes one or more mounting rails and said optical sight is attached to said one or more mounting rails.

12. The assembly of claim 7, wherein said tang mount portion and said scope mount portion form an acute angle therebetween.

* * * * *